United States Patent [19]

Shen

[11] 4,400,265

[45] Aug. 23, 1983

[54] CASCADE CATALYTIC DEWAXING/HYDRODEWAXING PROCESS

[75] Inventor: Roderick C. Shen, Belle Mead, N.J.

[73] Assignee: Mobil Oil Corporation, New York, N.Y.

[21] Appl. No.: 364,363

[22] Filed: Apr. 1, 1982

[51] Int. Cl.[3] ..... C10G 45/58; C10G 45/00

[52] U.S. Cl. ..... 208/97; 208/58; 208/211

[58] Field of Search ..... 208/97, 58, 211

[56] References Cited

U.S. PATENT DOCUMENTS

| | | | |
|---|---|---|---|
| Re. 28,398 | 4/1975 | Chen et al. | 208/111 |
| 3,291,721 | 12/1966 | Schuman | 208/97 |
| 3,472,759 | 10/1969 | Masologites et al. | 208/97 |
| 3,520,796 | 7/1970 | Murphy et al. | 208/33 |
| 3,617,475 | 11/1971 | Offutt et al. | 208/33 |
| 3,700,585 | 10/1972 | Chen et al. | 208/111 |
| 3,825,485 | 7/1974 | Coons, Jr. et al. | 208/97 |
| 3,894,938 | 7/1975 | Gorring et al. | 208/120 X |
| 3,984,305 | 10/1976 | Hosoi et al. | 208/97 X |
| 4,159,935 | 7/1979 | Scott | 208/58 X |
| 4,238,316 | 12/1980 | Mooi et al. | 208/58 |

*Primary Examiner*—Delbert E. Gantz
*Assistant Examiner*—Glenn A. Caldarola
*Attorney, Agent, or Firm*—Charles A. Huggett; Michael G. Gilman; Charles J. Speciale

[57] ABSTRACT

A high pour point, high sulfur content gas oil is processed in a combination process wherein the gas oil is first catalytically dewaxed and then hydrodesulfurized in a cascade system which enables the two operations to be integrated through a common hydrogen system and whereby substantial quantities of thermal energy are recovered for reuse resulting in significant energy conservation.

6 Claims, 1 Drawing Figure

CASCADE CATALYTIC DEWAXING/HYDRODEWAXING PROCESS

BACKGROUND OF THE INVENTION

1. Field of the Invention

This invention relates to a catalytic process for the conversion of petroleum feedstocks. More particularly, it relates to an improved catalytic process of dewaxing and desulfurization of gas oils. This invention especially relates to a combination process of catalytic dewaxing and catalytic desulfurization of gas oil.

2. Description of the Prior Art

Catalytic dewaxing of high-pour gas oils to low pour No. 2 fuel over a shape-selective zeolite catalyst of the ZSM-5 family which selectively cracks long-chain normal paraffins, slightly-branched isoparaffins and long-chain cycloparaffins is known in the art (e.g., U.S. Pat. No. 3,700,585 and its reissue, U.S. Pat. No. Re. 28,398, the entire contents of both of which are incorporated herein by reference). The catalytic dewaxing process disclosed in these patents (also known as Mobil Distillate Dewaxing or Distillate Dewaxing, MDDW and DDW, respectively), is often followed by a conventional hydrodesulfurization process (HDS) to remove substantially all sulfur from the product of the catalytic dewaxing process. The conventional hydrodesulfurization process is usually already present in a refinery; thus, the new catalytic dewaxing process may be incorporated into the refinery operations upstream or downstream of the HDS process, as required.

Prior to the development of the catalytic dewaxing process, high pour point oils were dewaxed by a conventional solvent dewaxing treatment. Although solvent dewaxing was also usually followed by the HDS process, it has been suggested in prior art to first subject the sulfur-containing high pour gas oils to the HDS process and then to the conventional solvent dewaxing process (see, e.g., U.S. Patents to Murphy, Jr. et al, U.S. Pat. No. 3,520,796 and to Offutt et al, U.S. Pat. No. 3,617,475). Murphy et al claim that this sequence of operations reduces the pour point of the product, and Offutt et al that it produces a product with better hazing characteristics. However, in the process sequence of both Offutt et al and Murphy, Jr. et al, the two unit operations (the HDS and the dewaxer) are used as physically and conceptually separate units connected only by the oil base stock entering the HDS unit and by the desulfurized product of the HDS unit entering the dewaxer. The only advantages claimed by Offutt et al and by Murphy, Jr., et al relate to the final product qualities.

Commonly assigned patent application Ser. No. 289,026, filed Aug. 31, 1981, discloses that substantial process and cost advantages can be attained if the conventional HDS unit is followed by the catalytic distillate dewaxing process unit (hereinafter DDW) and if a number of process streams flow between the units to maximize the utilization of compression and heat exchange capabilities between the two units.

The sequence of catalytic dewaxing of high pour point, high sulfur gas oils followed by hydrodesulfurization without intermediate product resolution is disclosed in U.S. Pat. No. 3,894,938 of Gorring et al. The benefits disclosed for this sequence include longer cycle time between regenerations and longer total life for the dewaxing catalyst. As in Offutt et al. and Murphy, Jr. et al. the two operations of Gorring et al. are employed as physically and conceptually separate units connected only by the product from the dewaxing unit serving as the feed to the HDS unit. No common hydrogen compression or energy saving concepts are employed or suggested in the process of Gorring et al.

It is an object of this invention to provide a combination process for reducing the pour point and the sulfur content of a gas oil.

It is another object of this invention to provide a combined process for dewaxing and desulfurizing a gas oil wherein common hydrogen systems are employed and heat energy conservation is practiced.

SUMMARY OF THE INVENTION

A catalytic distillate dewaxing process (DDW) is arranged in a cascade relationship with a catalytic hydrodesulfurization process (HDS) for the processing of high pour, high sulfur gas oils to permit the use of a common hydrogen system and to integrate the two operations whereby substantial quantities of thermal energy are recovered and transferred from one unit to the other. The processing sequence also results in a longer life for the dewaxing catalyst than is obtained when the sequence is reversed.

In particular this invention relates to a process for dewaxing and desulfurizing a gas oil which comprises:

(1) passing a gas oil boiling in the 400° to 900° F. range and having a pour point of above about +10° F. and a sulfur content of above about 0.3 weight percent in indirect heat exchange relationship with the dewaxed and desulfurized product recovered in step (23) herein, (2) passing a first gaseous stream comprising hydrogen in indirect heat exchange relationship with the first vapor phase from step (8) herein, (3) passing the first gaseous stream comprising hydrogen from step (2) in indirect heat exchange relationship with the dewaxed effluent from step (7) herein, (4) passing the gas oil from step (1) in indirect heat exchange relationship with the dewaxed effluent from step (3), the heat exchange of steps (3) and (4) being effective to provide, from said dewaxed effluent, a first liquid phase having a boiling range of about 330°-900° F. and a first vapor phase, (5) combining the gas oil from step (4) with the first gaseous stream comprising hydrogen from step (3) to provide the first combined streams, said first gaseous stream being provided in an amount to furnish hydrogen effective to hydrodewax said gas oil under the conditions of step (7) herein, (6) heating the first combined streams from step (5), the heat provided to the gas oil in steps (1) and (4), the first gaseous stream comprising hydrogen in steps (2) and (3) and the first combined streams in step (6) being effective to provide the first combined streams at the hydrodewaxing temperature of step (7) herein, (7) contacting the first combined streams from step (6) with a ZSM-5 type zeolite catalyst under hydrodewaxing conditions effective to reduce the pour point of said gas oil to between about +10° and −50° F. and provide a dewaxed effluent, (8) separating the dewaxed effluent from step (4) into a first liquid phase and a first vapor phase, (9) passing the first vapor phase from step (2) in indirect heat exchange relationship with the second liquid phase from step (11) herein,

(10) cooling the first vapor phase from step (9), the heat exchange of steps (2), (9) and (10) being effective to provide, from the first vapor phase, a second liquid phase having a boiling range of about 100°-630° F. and a second vapor phase,

(11) separating the first vapor phase from step (10) into a second liquid phase and a second vapor phase comprising hydrogen,

(12) recovering the second liquid phase from step (11) as wild naphtha,

(13) passing a second gaseous stream comprising hydrogen in indirect heat exchange relationship with the third vapor phase from step (19) herein, (14)passing the second gaseous stream comprising hydrogen from step (13) in indirect heat exchange relationship with the desulfurized effluent from step (18) herein,

(15) passing the first liquid phase from step (8) in indirect heat exchange relationship with the desulfurized effluent from step (14), the heat exchange of steps (14) and (15) being effective to provide, from said desulfurized effluent, a third liquid phase having a boiling range of about 330°-900° F. and a third vapor phase,

(16) combining the first liquid phase from step (15) with the second gaseous stream comprising hydrogen from step (14), to provide the second combined streams, said second gaseous stream being provided in an amount to furnish hydrogen effective to hydrodesulfurize said first liquid phase under the conditions of step (18) herein,

(17) heating the second combined streams from step (16), the heat provided to said first liquid phase in step (15), the second gaseous stream comprising hydrogen in steps (13) and (14) and the second combined streams in step (17) being effective to provide the second combined streams at the hydrosulfurization temperature of step (18) herein,

(18) contacting the second combined streams from step (17) with a hydrosulfurization catalyst under hydrodesulfurizing conditions effective to reduce the sulfur content of the first liquid phase to about 0.05 to about 0.5 wt.% and provide a desulfurized effluent,

(19) separating the desulfurized effluent from step (15) into a third liquid phase and a third vapor phase,

(20) passing the third vapor phase from step (13) in indirect heat exchange with the forth liquid phase from step (22) herein,

(21) cooling the third vapor phase from step (20), the heat exchange of steps (13), (20) and (21) being effective to provide, from said third vapor phase, a fourth liquid phase having a boiling range of about 100°-650° F. and a fourth vapor phase,

(22) separating the third vapor phase from step (21) into a fourth liquid phase and a fourth vapor phase comprising hydrogen and hydrogen sulfide, and

(23) recovering the third liquid phase as a dewaxed, and desulfurized gas oil product.

In an additional embodiment, the gaseous effluents from the dewaxing step and the desulfurization step of the process may be recycled to supply hydrogen to each step after removal of hydrogen sulfide generated during the desulfurization. In a further embodiment the dewaxed and desulfurized gas oil is subjected to steam stripping.

DESCRIPTION OF THE PREFERRED EMBODIMENTS

Figure 1:
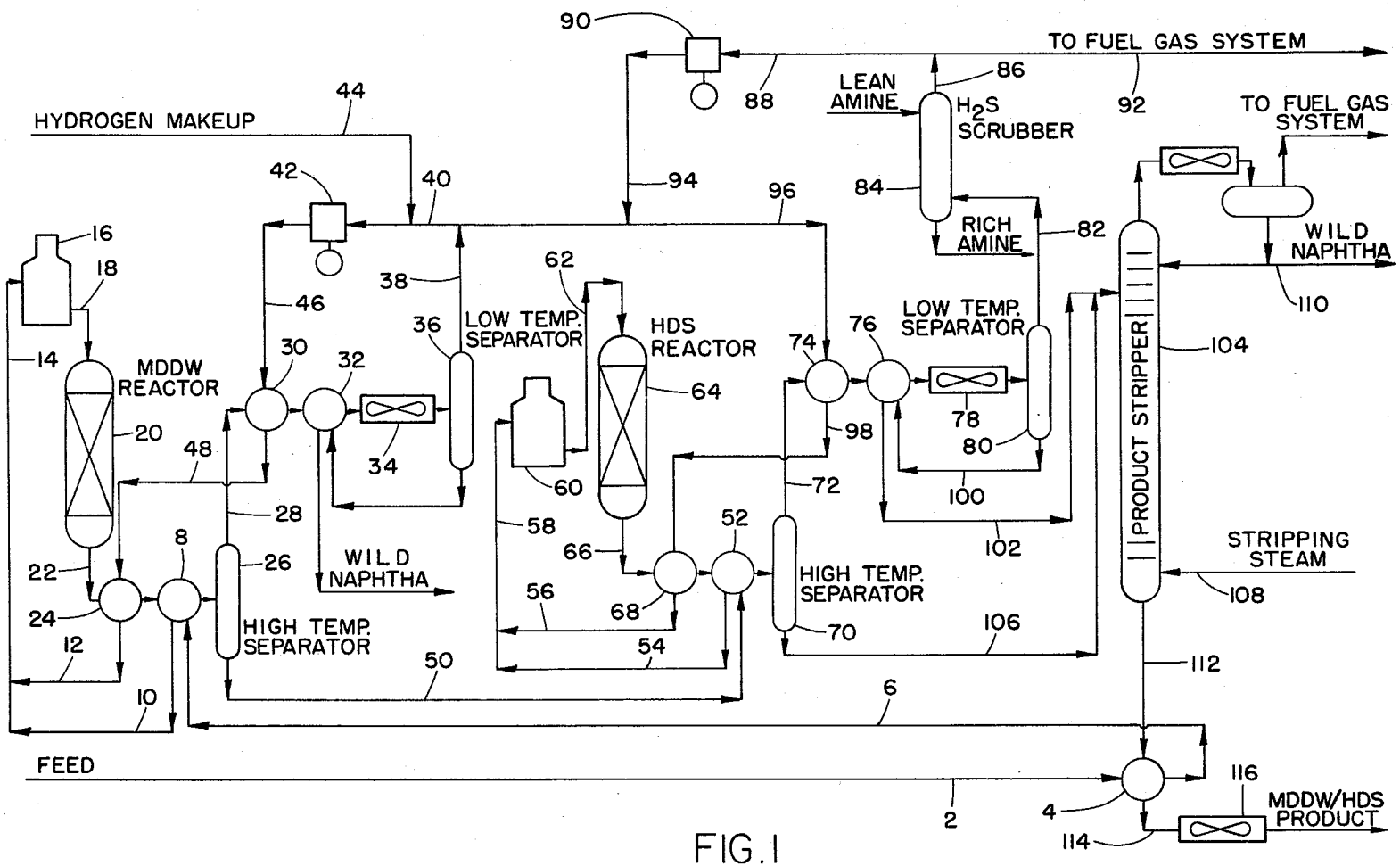
FIG. 1 is a schematic flowplan of an embodiment of the invention.

The present invention relates to a catalytic process for reducing the pour point and the sulfur content of a gas oil. The process of the present invention consists of two parts, a dewaxing step and a desulfurization step. In addition, the various liquid and gaseous streams of the several steps are integrated and brought into heat exchange relationship to provide an energy efficient process.

The feed to the process of this invention is a petroleum distillate known as gas oil having both a pour point and a sulfur content which are too high for a satisfactory diesel fuel, heating oil or other fuel oil. Typically, the gas oils employed in this invention have a boiling range in the 400° to 900° F. boiling range, exhibit a pour point of above about +10° F. and sulfur content of above about 0.5 weight percent. Those skilled in the art can appreciate that gas oils having properties differing somewhat from those described may be satisfactorily processed in accordance with the present invention by making appropriate adjustments to the operating conditions in the dewaxing process and the desulfurization process.

The dewaxing process used in the present invention is operated in the conventional manner of other catalytic dewaxing, such as that disclosed in U.S. Pat. No. 3,700,585 and U.S. Pat. No. Re. 28,398. Thus the catalyst used in the dewaxing process is a catalyst of the ZSM-5 type which includes the following specific zeolites: ZSM-5, ZSM-11, ZSM-23, ZSM-38 and ZSM-43 with ZSM-5 zeolite being particularly preferred.

ZSM-5 is more particularly described in U.S. Pat. No. 3,702,886, the entire contents of which are incorporated herein by reference.

ZSM-11 is more particularly described in U.S. Pat. No. 3,709,979, the entire contents of which are incorporated herein by reference.

ZSM-23 is more particularly described in U.S. Pat. No. 4,076,842, the entire contents of which are incorporated herein by reference.

ZSM-38 is more particularly described in U.S. Pat. No. 4,046,859, the entire contents of which are incorporated herein by reference.

ZSM-43 is more particularly described in European Patent Application Publication No. 0 015 132, published Sept. 3, 1980, the entire contents of which are incorporated herein by reference.

The conditions of the catalytic dewaxing are those of cracking of hydrocracking. Although the dewaxing may be practiced with or without hydrogen, it is preferred to employ hydrogen. Typical catalytic dewaxing conditions include a temperature between about 650° and about 1000° F., pressure between about 100 and about 3000 psig, preferably between about 200 and about 700 psig, liquid hourly space velocity (LHSV) between about 0.1 and about 10, preferably between about 0.5 and about 4 and a hydrogen rate of between about 500 and about 10,000 SCF/B, preferably between about 2000 and about 6000 SCF/B. The feed introduced into the dewaxing portion of this process is modified by incorporating quantities of hydrogen in the catalytic dewaxing reactor. In an embodiment this is accomplished by recycling a substantial amount of gaseous components from the low temperature separator associated with the dewaxing operation together with a quantity of fresh make-up hydrogen. These combined streams are added to the gas oil feed to the dewaxing reactor. The amount of gaseous components from the low temperature separator introduced into the catalytic reactor is such that the gases constitute about 50% to about 100%, preferably 80% to 100% of the total feed in the catalytic reactor. Accordingly, higher operating temperatures can be sustained in the catalytic reactor without a substantial increase in the amount of coke produced therein. Thus, the catalytic dewaxing reactor can be operated at a temperature of about 650° to about 1000° F. at hydrocracking process conditions with virtually no increase in coke production, as compared to the amount of coke produced at conventional hydrocracking conditions used in prior art catalytic dewaxing operations. Increased temperature of the catalytic dewaxing reactor produces a number of high temperature process streams exiting the reactor which, in turn, enables the operator of the process to recover a substantially higher proportion of thermal energy from such high temperature process streams in appropriate heat exchanging operations. In this connection, the gaseous components recycled into the catalytic dewaxing reactor are comprised of: vapor from the DDW low temperature separator, as well as make-up hydrogen.

The hydrodesulfurization process used in the present invention is any conventionally known hydrodesulfurization process (HDS) used in the art. For example, the catalyst used in the process could be any conventional hydrodesulfurization catalyst, such as a catalyst comprising a Group VIB (chromium, molybdenum, or tungsten) metal, and a Group VIII metal or their oxides or sulfides. The HDS process is conducted with the catalyst under hydroprocessing conditions comprising: a pressure of about 500 to about 3000 psig, preferably about 600 to about 800 psig; a temperature of about 345° C. (about 650° F.) to about 445° C. (about 850° F.), preferably about 370° C. (about 700° F.) to about 440° C. (about 820° F.); a liquid hourly space velocity of 0.1 to 6.0, preferably 0.4 to 4.0. The hydrogen gas used during the process of hydrodesulfurization is passed through the hydrodesulfurization reactor at the rate of between about 1000 and 15,000 SCF/B of feed and preferably between about 1000 and 8000 SCF/B. The hydrogen purity may vary from about 60 to 100%. If the hydrogen is recycled, as is customary, it is desirable to provide means of bleeding off a portion of the recycled gas and to add makeup in order to maintain the hydrogen purity within the specified range. The recycled gas is usually washed with a chemical absorbent for hydrogen sulfide or otherwise treated in a known manner to reduce the hydrogen sulfide content thereof prior to recycling. A hydrogen sulfide scrubber employing a monoethanolamine or a diethanolamine solution and known in the art as the MEA or the DEA process may be conveniently employed. The HDS process removes about 50% to about 99.5% by weight of the sulfur originally present in the feedstock. Feedstocks which can be used in the process are high-pour gas oils, such as straight run atmospheric and vacuum gas oils and cracked gas oils. Products of the process include: gas oils, naphthas and light ends.

In the present invention, the hydrogen makeup stream is preferably added to the catalytic dewaxing operation of the process and a portion thereof is subsequently recycled, after compression, to the HDS operation. Only a portion, e.g., between 40% and 50%, of the hydrogen stream introduced into the catalytic dewaxing process is subsequently recycled to the HDS process, depending on the relative amounts of hydrogen required for the two operations.

In addition, a number of high temperature process streams in the dewaxing process and in the desulfurization process are passed through various heat exchanging means with cooler process streams from one or both processes to extract the thermal energy from the high temperature streams.

The improvements described herein can be illustrated by reference to FIG. 1 which presents a flowplan of an embodiment of this invention. An atmospheric heavy gas oil having a boiling range of 400°-900° F., a pour point of +50° F. and a sulfur content of 2 weight percent is the feed to the process. This fresh gas oil feed enters the process through line 2, is heated to about 200° F. in heat exchanger 4 by the gas oil product stream from the process. The feed then flows through line 6 to heat exchanger 8 where it is further heated to about 450° F. by the effluent stream from the dewaxing reactor. The gas oil passes through line 10 where it is combined with a preheated recycle hydrogen stream supplied through line 12 at a temperature of about 550° F. The combined stream, at a temperature of about 520° F., flows through line 14 to heater 16 where the temperature of the combined stream is increased to about 800° F. The mixture of gas oil and hydrogen passes through line 18 into MDDW reactor 20 which contains a bed of ZSM-5 catalyst. Dewaxing conditions in the reactor include a pressure of about 680 psig and a LHSV of about 2. During passage through MDDW reactor 20 the paraffins and other high pour components of the gas oil are cracked thereby substantially reducing the pour point of the gas oil. The dewaxed effluent at a temperature of about 770° F. exits from reactor 20 through line 22 and flows through heat exchangers 24 and 8 where it gives up some of its heat to preheat the recycle hydrogen stream and the gas oil feed, respectively. The effluent then passes into high temperature separation 26 which is operated at a temperature of about 530° F. thereby causing the effluent to separate into a first liquid phase boiling in the 330°-900° F. range and a first vapor phase. The first vapor phase flows from high temperature separation 26 through line 28 and then through heat exchangers 30 and 32 and cooler 34 and into low temperature separator 36. The first vapor phase provides preheat to the recycle hydrogen stream as it passes through heat exchanger 30 and the vapor phase is cooled further by the liquid effluent from flow temperature separator 36 in heat exchanger 32. Cooler 34 then cools the first vapor phase so that a phase separation may be made in low temperature separator 36 which is operated at a temperature of about 100° F. and about 640 psig. The first vapor phase is separated in separator 36 into a naphtha distillate boiling in the 100°-630° F. range and a second vapor phase which contains hydrogen and gaseous products from the dewaxing operation. The naphtha distillate is a wild naphtha which will usually require stabilization by known means before being added to the gasoline pool. The second vapor phase passes through lines 38 and 40 to the suction of compressor 42 for compression from about 640 to about 740 psig and recycle to the dewaxing reactor. Make-up hydrogen, as required, is introduced from line 44 into line 40 for use in the process. To maintain the desired hydrogen purity, quantities of the recycle stream are purged from the system for disposition (not shown). The recycle hydrogen stream flows from compressor 42 through line 46 to heat exchanger 30 where it is heated from about 100° to about 340° F. by the gaseous phase from high temperature separator 26 and then through line 48 to heat exchanger 24 where the dewaxed effluent from MDDW reactor 22 further heats it to about 550° F. The preheated recycle hydrogen stream then passes through line 12, as explained above, where it is combined with the gas oil feed.

Returning to high temperature separator 26, the dewaxed gas oil, now at a temperature of about 530° F., is passed to the desulfurization stage for further processing. The gas oil flows through line 50 to heat exchanger 52 where it is heated to about 600° F. by the partially cooled effluent from the desulfurization reactor. The preheated dewaxed gas oil passes through line 54 where it is combined with a preheated recycle hydrogen stream supplied through line 56 at a temperature of about 580° F. The combined stream, at a temperature of about 560° F., flows through line 58 to heater 60 where the temperature of the combined stream is increased to about 750° F. The mixture of dewaxed gas oil and hydrogen passes through line 62 into HDS reactor 64 which contains a catalyst bed of cobalt-molybdenum on alumina. Desulfurization conditions in the reactor include a pressure of about 600 psig and a LHSV of about 2. During passage through HDS reactor 64, the sulfur components of the gas oil are converted to hydrogen sulfide thereby substantially reducing the sulfur content of the gas oil. The cascade principle utilized in the process of this invention is based on the use of a common hydrogen system so that the process streams pass from the MDDW reactor through the interconnecting pipes, heat heat exchangers, separators, etc. to the HDS reactor which operates at about a 50–100 psi lower pressure than the MDDW reactor.

The desulfurized effluent, at a temperature of about 800° F., exits from HDS reactor 64 through line 66 and flows through heat exchangers 68 and 52 where it gives up some of its heat to preheat the HDS recycle hydrogen stream and the dewaxed gas oil feed, respectively. The effluent then passes into high temperature separator 70 which is operated at a temperature of about 530° F. thereby causing the effluent to separate into a third liquid phase boiling in the 330°–900° F. range and a third vapor phase. The third vapor phase flows from high temperature separator 70 through line 72 and then through heat exchangers 74 and 76 and cooler 78 and into low temperature separator 80. The third vapor phase provides preheat to the HDS recycle hydrogen stream as it passes through heat exchanger 74 and the vapor phase is cooled further by the liquid effluent from low temperature separator 80 in heat exchanger 76. Cooler 78 then cools the third vapor phase so that a phase separation may be made in low temperature separation 80 which is operated at about 100° F. and about 560 psig. The third vapor phase is separated in separator 80 into a naphtha distillate boiling in the 100°–650° F. range and a fourth vapor phase which contains hydrogen and hydrogen sulfide. The fourth vapor phase passes through line 82 to $H_2S$ scrubber 84 where a solution of monoethanolamine or diethanolamine contacts the fourth vapor phase removing sufficient hydrogen sulfide to permit the fourth vapor phase to be recycled to the HDS reactor for reuse. The fourth vapor phase then passes through line 86 and 88 to the suction of compressor 90 for compression from about 550 to about 640 psig. As required to maintain the desired hydrogen purity, a purge stream of gas is removed through line 92 for disposal in the fuel gas system. The recycle hydrogen stream flows from compressor 90 through lines 94 and 96 to heat exchanger 74 where it is heated from about 100° to about 250° F. by the gaseous phase from high temperature separator 70 and then through line 98 to heat exchanger 68 where the desulfurized effluent from HDS reactor 64 further heats it to about 580° F. The preheated recycle hydrogen stream then passes through line 56, as explained above, where it is combined with the dewaxed gas oil feed.

The naphtha distillate from low temperature separator 80 flows through line 100 and heat exchanger 76 where it obtains some preheat from the third vapor phase. The heated naphtha passes through line 102 and is introduced into product stripper 104. The dewaxed and desulfurized gas oil, which is also referred to as the third liquid phase, flows from high temperature separator 70 through line 106 and is also introduced into product stripper 104. Stripping stream is introduced into the bottom of the stripper through line 108 to strip both the naphtha and the gas oil. The stripper operates at a tower top pressure of about 85 psig and a bottom pressure of about 110 psig. Wild naphtha at about 100° F. is recovered from the top of stripper 104 through line 110 for further processing prior to its addition to the gasoline pool. The product gas oil having a pour point of about 0° F. and a sulfur content of about 0.08 weight percent is removed from product stripper 104 at a temperature of about 480° F. through line 112. The gas oil flows to heat exchanger 4 where it provides some preheat to the gas oil feed to the process. The dewaxed and desulfurized gas oil then passes through line 114 to cooler 116 where it is cooled to the desired temperature before passing to product storage and further processing, as required.

What is claimed is:

1. A process for dewaxing and desulfurizing a gas oil which comprises:

(1) passing a gas oil boiling in the 400° to 900° F. range and having a pour point of above about +10° F. and a sulfur content of above about 0.3 weight percent in indirect heat exchange relationship with the dewaxed and desulfurized product recovered in step (23) herein, (2) passing a first gaseous stream comprising hydrogen in indirect heat exchange relationship with the first vapor phase from step (8) herein, (3) passing the first gaseous stream comprising hydrogen from step (2) in indirect heat exchange relationship with the dewaxed effluent from step (7) herein, (4) passing the gas oil from step (1) in indirect heat exchange relationship with the dewaxed effluent from step (3), the heat exchange of steps (3) and (4) being effective to provide, from said dewaxed effluent, a first liquid phase having a boiling range of about 330°–900° F. and a first vapor phase, (5) combining the gas oil from step (4) with the first gaseous stream comprising hydrogen from step (3) to provide the first combined streams, said first gaseous stream being provided in an amount to furnish hydrogen effective to hydrodewax said gas oil under the conditions of step (7) herein, (6) heating the first combined streams from step (5), the heat provided to the gas oil in steps (1) and (4), the first gaseous stream comprising hydrogen in steps (2) and (3) and the first combined streams in step (6) being effective to provide the first combined streams at the hydrodewaxing temperature of step (7) herein, (7) contacting the first combined streams from step (6) with a ZSM-5 type zeolite catalyst under hydrodewaxing conditions effective to reduce the pour point of said gas oil to between about +10° and −50° F. and provide a dewaxed effluent, (8) separating the dewaxed effluent from step (4) into a first liquid phase and a first vapor phase, (9) passing the first vapor phase from step (2) in indirect heat exchange relationship with the second liquid phase from step (11) herein,

(10) cooling the first vapor phase from step (9), the heat exchange of steps (2), (9) and (10) being effective to provide, from the first vapor phase, a second liquid phase having a boiling range of about 100°-630° F. and a second vapor phase,

(11) separating the first vapor phase from step (10) into a second liquid phase and a second vapor phase comprising hydrogen,

(12) recovering the second liquid phase from step (11) as wild naphtha,

(13) passing a second gaseous stream comprising hydrogen in indirect heat exchange relationship with the third vapor phase from step (19) herein,

(14) passing the second gaseous stream comprising hydrogen from step (13) in indirect heat exchange relationship with the desulfurized effluent from step (18) herein,

(15) passing the first liquid phase from step (8) in indirect heat exchange relationship with the desulfurized effluent from step (14), the heat exchange of steps (14) and (15) being effective to provide, from said desulfurized effluent, a third liquid phase having a boiling range of about 330°-900° F. and a third vapor phase,

(16) combining the first liquid phase from step (15) with the second gaseous stream comprising hydrogen from step (14), to provide the second combined streams, said second gaseous stream being provided in an amount to furnish hydrogen effective to hydrodesulfurize said first liquid phase under the conditions of step (18) herein,

(17) heating the second combined streams from step (16), the heat provided to said first liquid phase in step (15), the second gaseous stream comprising hydrogen in steps (13) and (14) and the second combined streams in step (17) being effective to provide the second combined streams at the hydrosulfurization temperature of step (18) herein,

(18) contacting the second combined streams from step (17) with a hydrosulfurization catalyst under hydrodesulfurizing conditions effective to reduce the sulfur content of the first liquid phase to about 0.05 to about 0.5 wt.% and provide a desulfurized effluent,

(19) separating the desulfurized effluent from step (15) into a third liquid phase and a third vapor phase,

(20) passing the third vapor phase from step (13) in indirect heat exchange with the fourth liquid phase from step (22) herein,

(21) cooling the third vapor phase from step (20), the heat exchange of steps (13), (20) and (21) being effective to provide, from said third vapor phase, a fourth liquid phase having a boiling range of about 100°-650° F. and a fourth vapor phase,

(22) separating the third vapor phase from step (21) into a fourth liquid phase and a fourth vapor phase comprising hydrogen and hydrogen sulfide, and

(23) recovering the third liquid phase as a dewaxed, and desulfurized gas oil product.

2. A process according to claim 1 wherein (a) a portion of the second vapor phase from step (11) together with fresh make-up hydrogen is compressed to provide the effective dewaxing pressure and to serve as the first gaseous stream of step (2), and (b) hydrogen sulfide is removed from a portion of the fourth vapor stream from step (22), the fourth vapor stream is then compressed to provide the effective hydrodesulfurization pressure and, together with a portion of the second vapor phase from step (11), serves as the second gaseous stream of step (13), the dewaxing pressure being about 50-100 psi higher than the desulfurization pressure.

3. A process according to claim 1 wherein the desulfurization catalyst comprises a Group VIB metal and a Group VIII metal or their oxides or sulfides.

4. A process according to claim 2 wherein the hydrogen sulfide removal is effected in a MEA process or a DEA process.

5. A process according to claim 1 including the following additional step:

(24) steam stripping the dewaxed and desulfurized gas oil product.

6. A process according to claim 2 wherein the hydrodewaxing conditions of step (7) comprise a temperature between about 650 and about 1000° F., a pressure between about 200 and about 700 psig, a LHSV between about 0.5 and about 4 and a hydrogen rate between about 2000 and about 6000 SCF/B, and the hydrodesulfurization conditions of step (18) comprise a temperature between about 700° and about 820° F., a pressure between about 600 and about 800 psig, a LHSV between about 0.4 and about 4 and a hydrogen rate of between about 1000 and about 8000 SCF/B, the hydrodewaxing pressure being about 50 to about 100 psi higher than the desulfurization pressure.

* * * * *

UNITED STATES PATENT AND TRADEMARK OFFICE

CERTIFICATE OF CORRECTION

PATENT NO. : 4,400,265

DATED : August 23, 1983

INVENTOR(S) : Roderick C. Shen

It is certified that error appears in the above—identified patent and that said Letters Patent is hereby corrected as shown below:

In the title, please change "CASCADE CATALYTIC DEWAXING/HYDRODEWAXING PROCESS" to read --CASCADE CATALYTIC DEWAXING/HYDRODESULFURIZING PROCESS--

Signed and Sealed this

*Thirty-first* Day of *January 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,400,265

DATED : August 23, 1983

INVENTOR(S) : Roderick C. Shen

It is certified that error appears in the above-identified patent and that said Letters Patent is hereby corrected as shown below:

Column 3, line 46 - change "forth" to --fourth--.

Column 4, line 32 - change "ZSM-43" to --ZSM-48--.

Column 4, line 46 - change "ZSM-43" to --ZSM-48--.

Column 4, line 51 - change "of" to --or--.

Signed and Sealed this

*Twelfth* Day of *June 1984*

[SEAL]

*Attest:*

GERALD J. MOSSINGHOFF

*Attesting Officer*

*Commissioner of Patents and Trademarks*